US009176427B2

(12) United States Patent
Tamaki et al.

(10) Patent No.: US 9,176,427 B2
(45) **Date of Patent: *Nov. 3, 2015**

(54) DEVELOPING DEVICE AND IMAGE FORMING APPARATUS THEREWITH

(71) Applicant: KYOCERA Document Solutions Inc., Osaka (JP)

(72) Inventors: Kenichi Tamaki, Osaka (JP); Hiroshi Yamazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/330,999

(22) Filed: Jul. 14, 2014

(65) Prior Publication Data

US 2015/0078786 A1 Mar. 19, 2015

(30) Foreign Application Priority Data

Sep. 18, 2013 (JP) ..... 2013-192556

(51) Int. Cl.
*G03G 15/08* (2006.01)

(52) U.S. Cl.
CPC ..... *G03G 15/0889* (2013.01); *G03G 15/0891* (2013.01); *G03G 15/0893* (2013.01)

(58) Field of Classification Search
USPC ..... 399/254
See application file for complete search history.

(56) References Cited

U.S. PATENT DOCUMENTS

| | | | | | |
|---|---|---|---|---|---|
| 4,324,483 | A * | 4/1982 | Tagawa et al. | ..... | 399/272 |
| 5,717,973 | A * | 2/1998 | Endoh et al. | ..... | 399/29 |
| 6,055,401 | A * | 4/2000 | Tonomoto et al. | ..... | 399/269 |
| 6,122,472 | A * | 9/2000 | Sako et al. | ..... | 399/254 |
| 2006/0165440 | A1 * | 7/2006 | Adachi | ..... | 399/254 |
| 2011/0158700 | A1 | 6/2011 | Iwata | ..... | 399/254 |
| 2012/0163873 | A1 * | 6/2012 | Mihara et al. | ..... | 399/254 |
| 2014/0023404 | A1 | 1/2014 | Iwata | ..... | 399/254 |

FOREIGN PATENT DOCUMENTS

| | | | |
|---|---|---|---|
| EP | 2 343 605 | A2 | 7/2011 |
| JP | 2001-249527 | A | 9/2001 |
| JP | 2001-312128 | A | 11/2001 |
| JP | 2012-163791 | A | 8/2012 |

* cited by examiner

*Primary Examiner* — Clayton E Laballe
*Assistant Examiner* — Linda B Smith
(74) *Attorney, Agent, or Firm* — Stein IP, LLC

(57) ABSTRACT

A developing device includes: a developer container having first and second transport passages, for containing developer; a developer carrier for carrying, on its surface, developer inside the second transport passage; a first stirring/transporting member having a rotary shaft and a transport blade formed on its circumferential surface, for stirring/transporting developer inside the first transport passage; a second stirring/transporting member for stirring/transporting developer inside the second transport passage in a direction opposite to the first stirring/transporting member; a first developer passing portion for delivering developer from the first to the second transport passage; and a second developer passing portion for delivering developer from the second to the first transport passage. In a part of the first stirring/transporting member facing the first developer passing portion, a paddle portion is formed which is devoid of the rotary shaft and which has a plurality of first ribs parallel to the rotary shaft.

8 Claims, 10 Drawing Sheets

--Related Art--

--Related Art--

DEVELOPING DEVICE AND IMAGE FORMING APPARATUS THEREWITH

INCORPORATION BY REFERENCE

This application is based upon and claims the benefit of priority from the corresponding Japanese Patent Application No. 2013-192556, filed on Sep. 18, 2013, the entire contents of which are incorporated herein by reference.

BACKGROUND OF THE INVENTION

The present disclosure relates to a developing device for incorporation in an image forming apparatus such as a copier, facsimile machine, printer, or the like, and to an image forming apparatus incorporating such a developing device. More particularly, the present disclosure relates to a method of suppressing agglomeration and solidification of developer inside a developing device.

Conventionally, as image development methods using dry toner in image forming apparatuses relying on an electrophotographic process, there are known a one-component development method, which uses a one-component developer containing magnetic toner alone, and a two-component development method, which uses a two-component developer designed to electrically charge non-magnetic toner by use of magnetic carrier and which develops an electrostatic latent image on an image carrier (photosensitive member) with a magnetic brush formed on a developing roller and composed of magnetic carrier and toner.

In developing devices as mentioned above, as development operation proceeds, toner is consumed. To cope with that, a toner sensor for detecting the concentration (or amount) of toner is provided inside a developing device, and as toner is consumed through development, so much new toner is supplied. Here, with a two-component development method, toner and carrier need to be stirred and mixed sufficiently so that the toner is electrically charged up to a predetermined amount of electric charge. Also with a one-component development method, the toner existing inside the developing device and the newly supplied toner need to be mixed sufficiently so as to have an even distribution of electric charge.

To that end, according to a widely practiced method, a circulation passage for developer is provided inside a developing device, and the developer is circulated and transported, while being stirred and mixed, by a stirring/transporting member arranged inside the circulation passage which is in the form of a screw and which is composed of a rotary shaft and a helical blade. Specifically, in a developing device 101 as shown in FIG. 13, the interior of a developer container 102 is partitioned into a first transport passage 105 and a second transport passage 107 by a partition wall 103. Inside the first transport passage 105 and the second transport passage 107, a first spiral 109 and a second spiral 110 are rotatably arranged which transport the developer while mixing and stirring it.

The developer is transported, while being stirred, in the axial direction (in the directions indicated by arrows A1 and A2 in FIG. 13) by the first spiral 109 and the second spiral 110, and is circulated between the first transport passage 105 and the second transport passage 107 through developer passing portions 111*a* and 111*b* formed in both end parts of the partition wall 103. Thus, the first transport passage 105, the second transport passage 107, and the developer passing portions 111*a* and 111*b* form a circulation passage for developer inside the developer container 102.

There is also proposed a method for suppressing uneven distribution of developer in a developer passing portion. For example, in one known developing device, in a part, facing a developer passing portion, of a stirring/transporting member arranged farther from a developing roller, a paddle piece is provided along a rotary shaft, and this results in an improved developer transporting ability at the developer passing portion.

According to another known developing device provided with a developer discharge port, in a part of a stirring/transporting member facing a developer passing portion, a devoid portion devoid of a rotary shaft is formed, and this results in a reduced speed of developer colliding with a developer regulating member.

SUMMARY OF THE INVENTION

According to one aspect of the present disclosure, a developing device is provided with a developer container, a developer carrier, a first stirring/transporting member, a second stirring/transporting member, a first developer passing portion, and a second developer passing portion. The developer container has a first transport passage and a second transport passage arranged substantially parallel to each other, and contains developer containing toner. The developer carrier is rotatably supported on the developer container, and carries, on its surface, the developer inside the second transport passage. The first stirring/transporting member is composed of a rotary shaft and a transport blade formed on its circumferential surface, and stirs and transports the developer inside the first transport passage. The second stirring/transporting member stirs and transports the developer inside the second transport passage in the direction opposite to the first stirring/transporting member. Through the first developer passing portion, the developer is delivered from the first transport passage to the second transport passage. Through the second developer passing portion, the developer is delivered from the second transport passage to the first transport passage. In a part of the first stirring/transporting member facing the first developer passing portion, a paddle portion is formed which is devoid of the rotary shaft and which includes a plurality of first ribs parallel to the rotary shaft.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
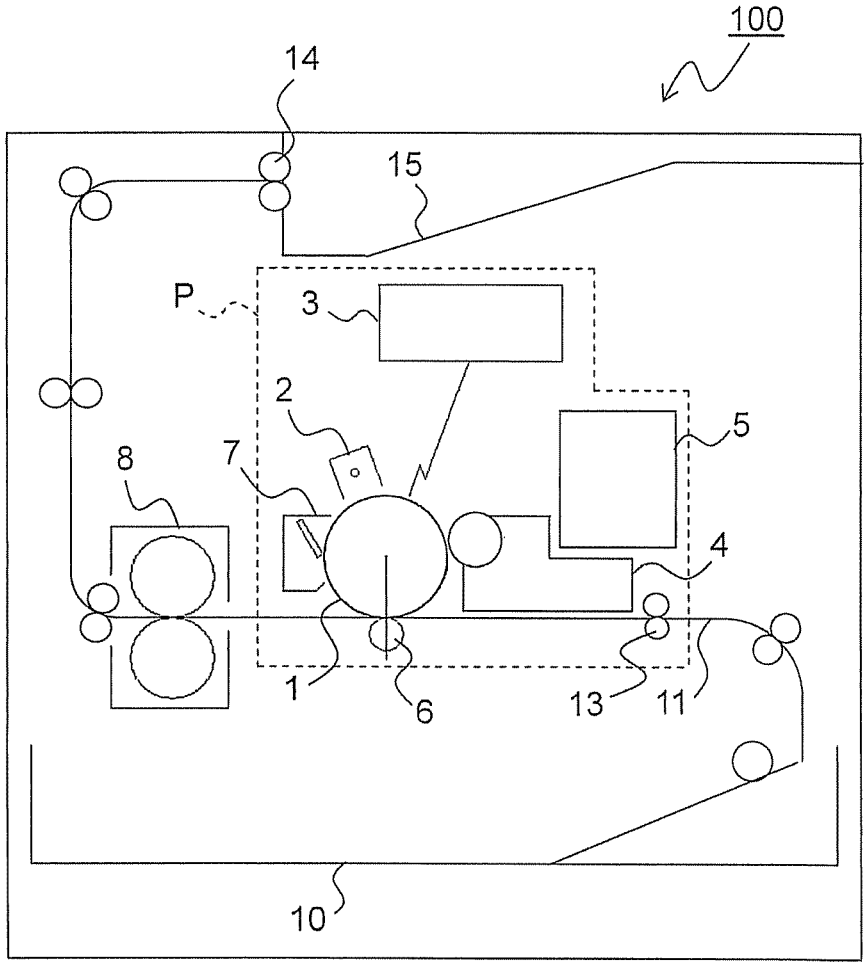
FIG. 1 is a schematic sectional view showing an overall construction of an image forming apparatus 100 provided with a developing device 4 according to the present disclosure.

Hereinafter, with reference to the accompanying drawings, embodiments of the present disclosure will be described. FIG. 1 is a schematic sectional view showing the construction of an image forming apparatus 100 provided with a developing device 4 according to one embodiment of the present disclosure. In the image forming apparatus (for example, a monochrome printer) 100, when an image forming operation is performed, an electrostatic latent image based on document image data transmitted from an unillustrated personal computer (PC) is formed in an image forming section P inside the apparatus main body, and the developing device 4 attaches toner to the electrostatic latent image to form a toner image. The toner is fed to the developing device 4 from a toner container 5. In this image forming apparatus 100, while a photosensitive drum 1 is rotated in a clockwise direction in FIG. 1, an image forming process is executed with respect to the photosensitive drum 1.

In the image forming section P, there are arranged, along the rotation direction of the photosensitive drum 1 (in the clockwise direction), a charging portion 2, an exposure unit 3, a developing device 4, a transfer roller 6, a cleaning device 7, and a static eliminator (unillustrated). The photosensitive drum 1 is, for example, an aluminum drum coated with a photosensitive layer, and its surface can be electrically charged by the charging portion 2. As the surface is irradiated with a laser beam from the exposure unit 3, which will be described later, the electric charge is so attenuated as to form an electrostatic latent image. There is no particular restriction on the photosensitive layer, which preferably is, for example, a layer of amorphous silicon (a-Si), which excels in durability, or an organic photosensitive layer (OPC), which generates little ozone when electrically charged and which offers a high-resolution image.

The charging portion 2 serves to electrically charge the surface of the photosensitive drum 1 uniformly. Used as the charging portion 2 is, for example, a corona discharge device which causes electric discharge by application of a high voltage to a thin piece of wire acting as an electrode. Usable instead of a corona discharge is a contact-type charging device which applies a voltage while keeping the surface of a photosensitive member in contact with a charging member as exemplified by a charging roller. The exposure unit 3 irradiates the photosensitive drum 1 with a light beam (for example, a laser beam) based on image data, and thereby forms an electrostatic latent image on the surface of the photosensitive drum 1.

The developing device 4 serves to form a toner image by attaching toner to the electrostatic latent image on the photosensitive drum 1. Here, magnetic one-component developer (hereinafter also referred to simply as toner) containing a magnetic toner component alone is contained in the developing device 4. The structure of the developing device 4 will be described in detail later. The transfer roller 6 transfers, without disturbing, the toner image formed on the surface of the photosensitive drum 1 to paper that is transported through a paper transport passage 11. The cleaning device 7 is provided with a cleaning roller, a cleaning blade, or the like that makes line contact with the photosensitive drum 1 in its longitudinal direction, and removes unused toner that remains on the surface of the photosensitive drum 1 after the transfer of the toner image to the paper.

Then, the exposure unit 3 irradiates the photosensitive drum 1 with a laser beam (a ray of light) based on previously entered image data, and thereby forms an electrostatic latent image based on the image data on the surface of the photosensitive drum 1. Thereafter, the developing device 4 attaches toner to the electrostatic latent image to form a toner image.

Toward the image forming section P, where the toner image has now been formed as described above, paper is transported with predetermined timing from a paper storage portion 10 through the paper transport passage 11 via a registration roller pair 13, so that in the image forming section P, the transfer roller 6 transfers the toner image on the surface of the photosensitive drum 1 to the paper. The paper having the toner image transferred to it is separated from the photosensitive drum 1, and is transported to a fusing portion 8, where, under application of heat and pressure, the toner image is fused on the paper. The paper having passed through the fusing portion 8 passes between a discharge roller pair 14, and is discharged onto a paper discharge portion 15.

Figure 2:
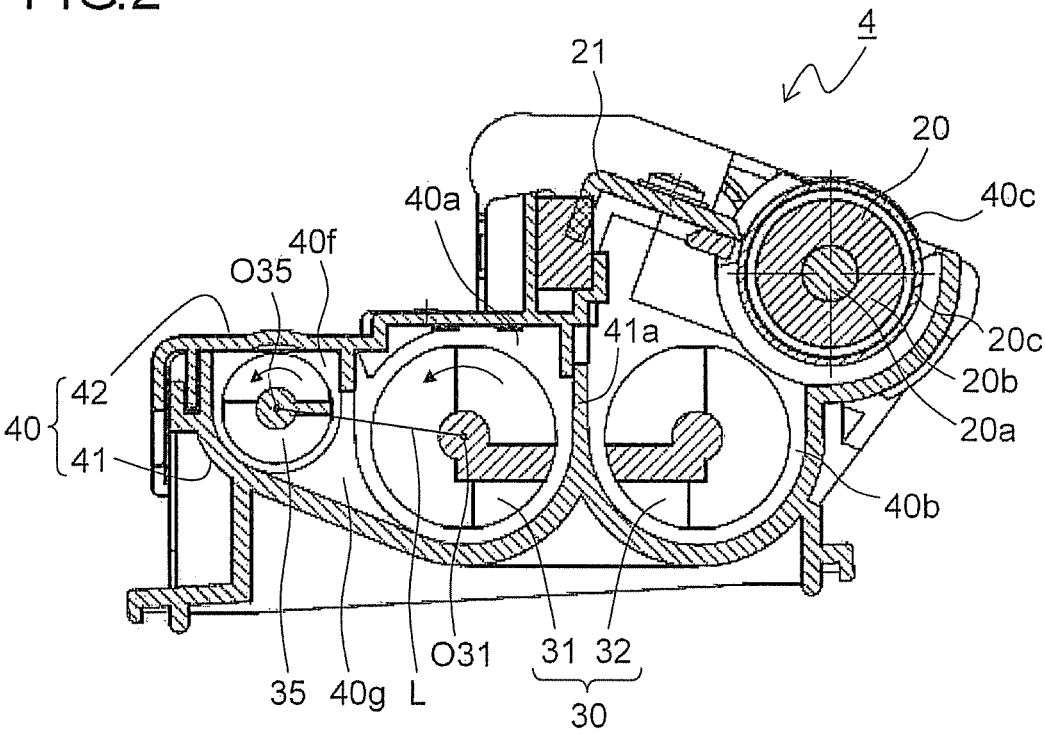
FIG. 2 is a side sectional view showing a structure of a developing device 4 according to a first embodiment of the present disclosure.

FIG. 2 is a side sectional view showing the structure of a developing device 4 according to a first embodiment of the present disclosure. Now, with reference to FIG. 2, the structure of the developing device 4 will be described in detail. FIG. 2 is a view from behind of what is shown in FIG. 1, and accordingly, in FIG. 2, the arrangement of components inside the developing device 4 is reversed left to right as compared with that in FIG. 1.

As shown in FIG. 2, the developing device 4 is composed of, among others, a developing roller (developer carrier) 20, a regulating blade 21, a stirring/transporting member 30, a developer feeding member 35, and a developer container 40 in which those are housed.

The developer container 40 forms the housing of the developing device 4, and has a body portion 41, which is open at the top face, and a cover member 42, which covers the top face of the body portion 41. The interior of the developer container 40 is partitioned into a first transport passage 40*a* and a second transport passage 40*b* by a partition wall 41*a* formed in the body portion 41. The first transport passage 40*a* and the second transport passage 40*b* are charged with one-component developer containing magnetic toner alone. The developer container 40 rotatably holds the stirring/transporting member 30, the developer feeding member 35, and the developing roller 20. In the developer container 40, an opening 40*c* is formed through which the developing roller 20 is exposed toward the photosensitive drum 1 (see FIG. 1).

The developing roller 20 is arranged opposite the photosensitive drum 1 across a predetermined interval. In a region of the developing roller 20 located opposite, hence close to, the photosensitive drum 1, the developing roller 20 feeds toner to the photosensitive drum 1. The stirring/transporting member 30 is arranged obliquely below, specifically to the lower left of, the developing roller 20. The regulating blade 21 is fixedly held by the developer container 40, on the left side of the developing roller 20.

The stirring/transporting member 30 is composed of two spirals, namely, a first spiral (first stirring/transporting member) 31 and a second spiral (second stirring/transporting member) 32. The second spiral 32 is arranged obliquely below, specifically to the lower left of, the developing roller 20, inside the second transport passage 40*b*, and the first spiral 31 is arranged next to, on the left side of, the second spiral 32, inside the first transport passage 40*a*.

The first and second spirals 31 and 32 transport developer while stirring it. In both end parts of the partition wall 41*a* (which partitions between the first transport passage 40*a* and the second transport passage 40*b*) in its longitudinal direction (the direction perpendicular to the plane of FIG. 2), developer passing portions (a first developer passing portion 40*d* and a second developer passing portion 40*e*, which will be described later) are provided. As the first spiral 31 rotates, developer is transported to the second spiral 32 via one of the developer passing portions (the first developer passing portion 40*d*), and the developer circulates inside the first transport passage 40*a* and the second transport passage 40*b*. The developer is then fed from the second spiral 32 to the developing roller 20.

The developing roller 20 is composed of, among others, a fixed shaft 20*a*, a magnetic pole member 20*b*, and a sleeve 20*c* formed of a non-magnetic metal in a cylindrical shape. The developing roller 20 is rotated in the clockwise direction in FIG. 2 by a driving mechanism comprising a motor and gears (none of these is illustrated).

As the sleeve 20*c* under application of a developing bias rotates, in a developing region (a region where the developing roller 20 and the photosensitive drum 1 face each other), the difference between the potential of the developing bias and the potential of the exposed part of the photosensitive drum 1 causes the developer (toner) carried on the surface of the sleeve 20*c* to fly to the photosensitive drum 1. The flying toner attaches, sequentially, to the exposed part of the photosensitive drum 1 in rotation, and thereby the electrostatic latent image on the photosensitive drum 1 is developed.

Figure 3:
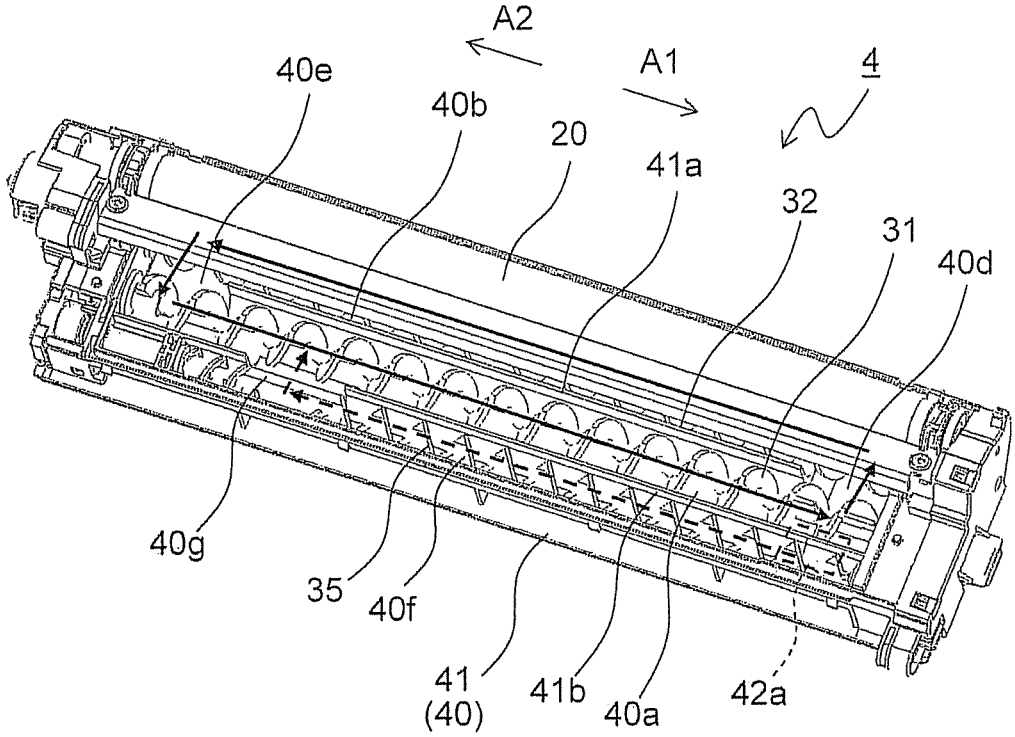
FIG. 3 is an exterior perspective view of a developing device 4, in a state with a cover member 42 removed, according to the first embodiment.
Figure 4:
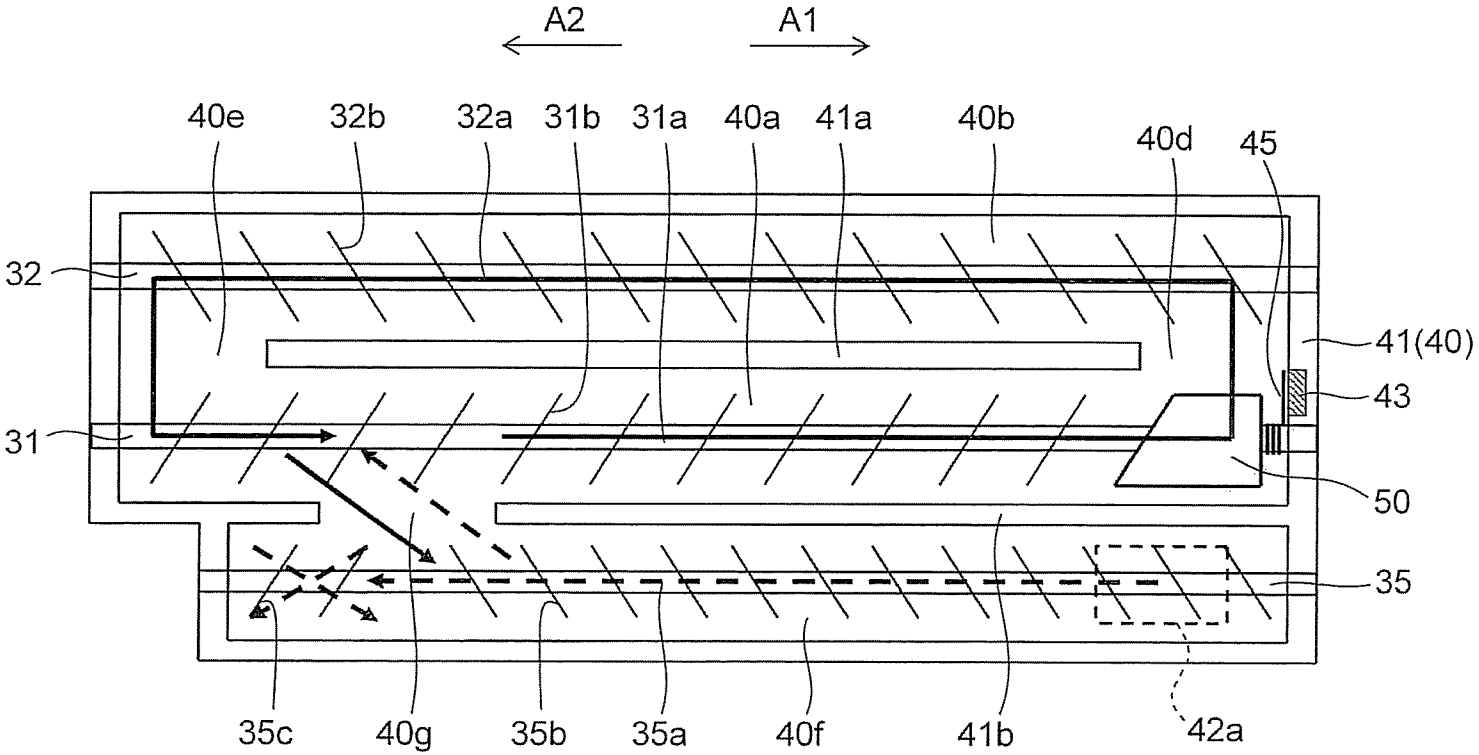
FIG. 4 is a plan sectional view showing a structure of a stirring portion of a developing device 4 according to the first embodiment.

FIG. 3 is an exterior perspective view of the developing device 4 according to the first embodiment, in a state with the cover member 42 removed, according to the first embodiment. FIG. 4 is a plan sectional view showing the structure of a stirring portion of the developing device 4 according to the first embodiment. As shown in FIGS. 3 and 4, in the developer container 40, there are formed a partition wall 41*a*, a first transport passage 40*a*, a second transport passage 40*b*, and developer passing portions 40*d* and 40*e*, and there is further formed a developer refill passage 40*f*. The developer refill passage 40*f* is a passage through which new developer (refill toner) is supplied from the toner container 5 into the first transport passage 40*a*.

The first transport passage 40*a*, the second transport passage 40*b*, and the developer refill passage 40*f* are arranged side by side. The partition wall 41*a* extending in the longitudinal direction of the developer container 40 is provided so as to partition between the first transport passage 40*a* and the second transport passage 40*b*, and a partition wall 41*b* extending in the longitudinal direction of the developer container 40 is provided so as to partition between the developer refill passage 40*f* and the first transport passage 40*a*. It is assumed that, in the first transport passage 40*a*, the left side in FIG. 3 is the upstream side and the right side in FIG. 3 is the downstream side, and that, in the second transport passage 40*b*, the right side in FIG. 3 is the upstream side and the left side in FIG. 3 is the downstream side.

The first developer passing portion 40*d* and the second developer passing portion 40*e* are formed at one and the other ends (at A1- and A2-direction ends), respectively, of the partition wall 41*a* in its longitudinal direction. Through the first developer passing portion 40*d*, respective A1-direction end parts of the first transport passage 40*a* and the second transport passage 40*b* communicate with each other. Through the second developer passing portion 40*e*, respective A2-direction end parts of the first transport passage 40*a* and the second transport passage 40*b* communicate with each other. Thus, developer can circulate inside the first transport passage 40*a*, the first developer passing portion 40*d*, the second transport passage 40*b*, and the second developer passing portion 40*e*.

On an inner wall surface of the first transport passage 40*a* near the first developer passing portion 40*d*, a toner sensor 43 is provided which detects the amount of developer (amount of toner) inside the developer container 40. Used as the toner sensor 43 is a magnetic permeability sensor that detects the magnetic permeability of the toner (magnetic one-component toner) inside the developer container 40. The toner sensor 43 detects the magnetic permeability of the toner, and outputs the detection result in the form of a voltage value to a controller (unillustrated), so that the controller determines the amount of remaining toner based on the output value of the sensor. According to the detection result of the toner sensor 43, the developer (toner) stored in the toner container 5 (see FIG. 1) is supplied through a refill port 42*a* into the developer container 40. Usable as the toner sensor 43 other than a magnetic permeability sensor as mentioned above is, for example, a piezoelectric sensor which outputs an electrical signal representing a pressure acting on a detection surface.

A rotary shaft 31*a* of the first spiral 31 is provided with a cleaning member 45 which is formed of a springy material. As the first spiral 31 rotates, the cleaning member 45 rotates together to clean the detection surface of the toner sensor 43.

Figure 5:
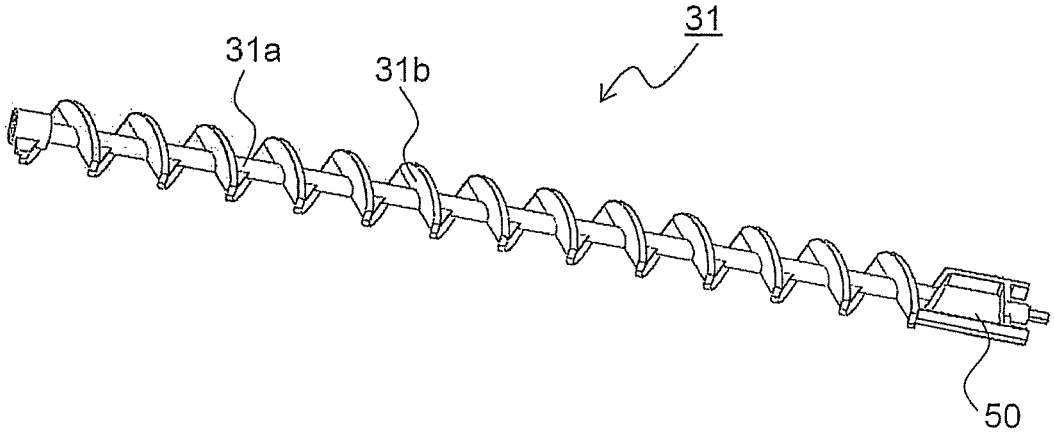
FIG. 5 is a perspective view showing a structure of a first spiral 31 used in a developing device 4 according to the first embodiment.

FIG. 5 is a perspective view showing the structure of the first spiral 31 used in the developing device 4 according to the first embodiment. As shown in FIGS. 3 to 5, the first spiral 31 has a rotary shaft 31*a*, which is rotatably supported on the developer container 40, and a first helical blade 31*b*, which is provided integrally with the rotary shaft 31*a* and which is substantially arc-shaped and formed in a helical shape with a predetermined pitch in the axial direction of the rotary shaft 31*a*. The first helical blade 31*b* is so configured as to have increasing thickness (length in the longitudinal direction) from the outer edge toward the rotary shaft 31*a*, and transports, while stirring, the developer inside the first transport passage 40*a* in the A1 direction. In an end part of the first spiral 31 (a downstream-side end part in the developer transport direction) facing the first developer passing portion 40*d* (see FIG. 4), a paddle portion 50 is formed which is devoid of the rotary shaft 31*a* and which is in the shape of a frame. The rotary shaft 31*a*, the first helical blade 31*b*, and the paddle portion 50 are molded integrally out of resin, such as ABS, to which developer is unlikely to attach.

Figure 6:
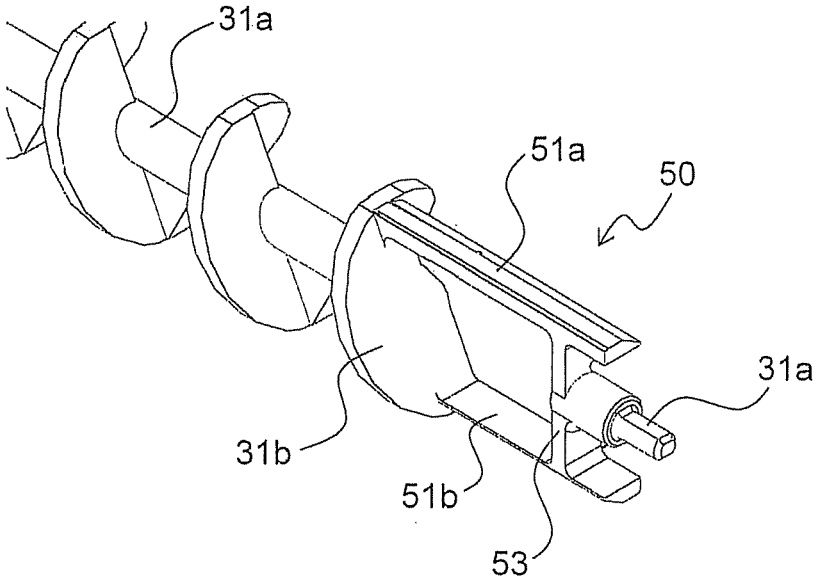
FIG. 6 is a partly enlarged view of and around a paddle portion 50 in FIG. 5.

FIG. 6 is a partly enlarged view of and around the paddle portion 50 in FIG. 5. The paddle portion 50 has a rectangular shape as seen in a plan view, being surrounded by a most downstream-side end part of the first helical blade 31*b* with respect to the developer transport direction, two first ribs 51*a* and 51*b* extending from the first helical blade 31*b* parallel to the rotary shaft 31*a*, and a second rib 53 coupling together respective end parts of the first ribs 51*a* and 51*b* and extending perpendicularly to the rotary shaft 31*a*. The second rib 53 is, on its face facing away from the face where it is connected to the first ribs 51*a* and 51*b*, connected to the rotary shaft 31*a*.

The second spiral 32 has a helical blade winding in the opposite direction (in the opposite phase) and has no paddle portion 50; otherwise it has a structure similar to that of the first spiral 31 shown in FIG. 5. Specifically, the second spiral 32 has a rotary shaft 32*a*, and a second helical blade 32*b* provided integrally with the rotary shaft 32*a* and formed in a helical shape to have a blade winding with the same pitch as, but in the opposite direction (in the opposite phase) to, the first helical blade 31*b* in the axial direction of the rotary shaft 32*a*. The rotary shaft 32*a* is arranged parallel to the rotary shaft 31*a*, and is rotatably supported on the developer container 40. The second helical blade 32*b* transports, while stirring, the developer inside the second transport passage 40*b* in the A2 direction (in the direction opposite to the A1 direction) to feed it to the developing roller 20.

Figure 7:
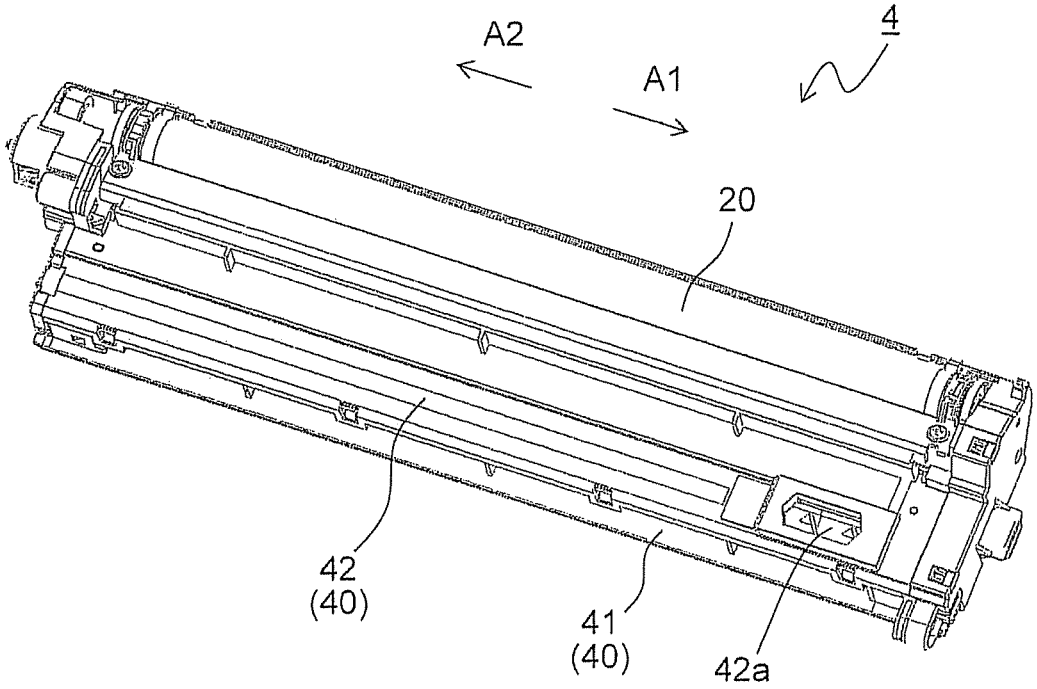
FIG. 7 is an exterior perspective view of a developer 4 according to the first embodiment.

As shown in FIG. 7, in an A1-direction end part of the developer refill passage 40*f*, there is formed, in the cover member 42, a refill port 42*a* through which new developer (toner) is fed from the toner container 5 provided over the developer container 40 into the developer container 40.

The developer refill passage 40*f* is a passage through which the developer fed to an A1-direction end portion is transported in the A2 direction so as to be fed to the upstream side of the first transport passage 40*a*. In the developer refill passage 40*f*, a feeding portion 40*g* is formed through which developer is fed from the developer refill passage 40*f* to the first transport passage 40*a*. The feeding portion 40*g* is formed, with respect to the developer transport direction inside the developer refill passage 40*f* (the A2 direction), on the upstream side (on the right side in FIG. 4) of a downstream-side end part (a left end part in FIG. 4) of the developer refill passage 40*f*, and in addition on the downstream side (on the left side in FIG. 4) of the refill port 42*a*.

Figure 8:
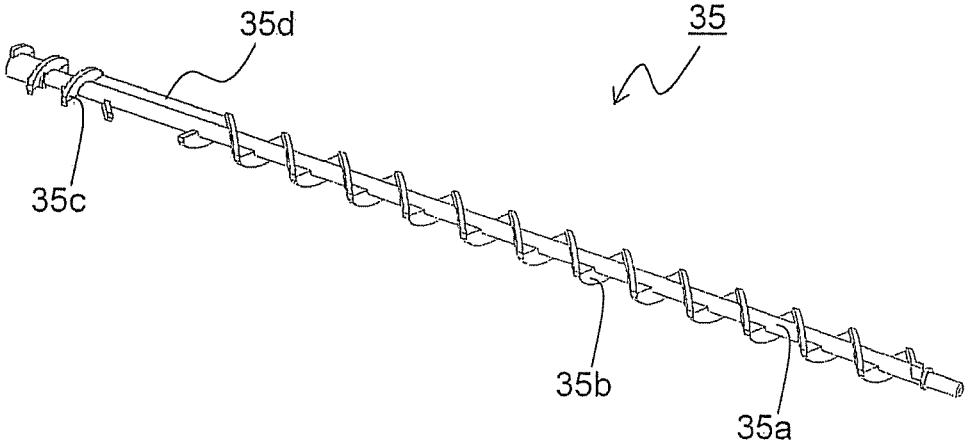
FIG. 8 is a perspective view showing a structure of a developer feeding member 35 used in a developing device 4 according to the first embodiment.

Inside the developer refill passage 40*f*, the developer feeding member 35 is arranged parallel to the first spiral 31 and the second spiral 32. As shown in FIGS. 3 and 8, the developer feeding member 35 has a rotary shaft 35*a*, and a third helical blade 35*b* and a fourth helical blade 35*c* provided integrally with the rotary shaft 35*a*. The third helical blade 35*b* is formed in a helical shape to have a blade winding in the opposite direction (in the opposite phase) to the first helical blade 31*b* in the axial direction of the rotary shaft 35*a*, and is formed to extend from the refill port 42*a* (see FIG. 7) to the feeding portion 40*g*. The fourth helical blade 35*c* is formed in a helical shape to have a blade winding in the opposite direction (in the opposite phase) to the third helical blade 35*b*, and is formed to extend from the feeding portion 40*g* to an A2-direction end part. In a part of the rotary shaft 35*a* facing the feeding portion 40*g*, a transport blade 35*d* in the shape of a paddle is formed.

The developer feeding member 35 is configured to rotate in the same direction as the first spiral 31 (in the counter-clockwise direction in FIG. 2), so that the developer fed to refill port 42*a* is transported toward the feeding portion 40*g*. Having mutually opposite phases, the third helical blade 35*b* and the fourth helical blade 35*c* cause developer to collide from opposite sides, allowing it to be transported to the first transport passage 40*a*.

The developer feeding member 35, the first spiral 31, and the second spiral 32 are each driven to rotate by a driving mechanism comprising a motor and gears (none of these is illustrated).

In this embodiment, in an end part of the first spiral 31 facing the first developer passing portion 40*d*, a paddle portion 50 in the shape of a frame is provided. Thus, the developer inside the first transport passage 40*a* is first transported to a downstream-side end part (a right end part in FIG. 4) of the first transport passage 40*a* by the spiral portion (where the first helical blade 31*b* is formed) of the first spiral 31, and is then promptly fed out to the first developer passing portion 40*d* by the two first ribs 51*a* and 51*b* of the paddle portion 50. As a result, no stagnation or agglomeration of developer occurs around the first developer passing portion 40*d*, and this helps suppress attachment of developer to, for example, an inner wall surface of the developer container 40.

The paddle portion 50 is devoid of the rotary shaft 31*a*, and thus an ample space is secured around the first ribs 51*a* and 51*b*. Thus, even when developer deteriorates and has lower flowability, it passes through the hollow part of the paddle portion 50 (the space between the first ribs 51*a* and 51*b*), and thus it is also possible to suppress attachment of developer to the first ribs 51*a* and 51*b*.

Moreover, the paddle portion 50 is formed by use of a part of the first helical blade 31*b* located at the most downstream-side end with respect to the developer transport direction. It is thus possible to transport developer to the paddle portion 50 efficiently without attenuating the thrusting force (transporting force) exerted by the first helical blade 31*b* in the direction of the rotary shaft 31*a*.

Here, to ensure that the developer inside the first transport passage 40*a* is transported to a downstream-side end part of the first transport passage 40*a* facing the first developer passing portion 40*d*, it is preferable that at least a most downstream-side part of the first helical blade 31*b* forming the paddle portion 50 overlap the first developer passing portion 40*d* in the direction of the rotary shaft 31*a* (so as to protrude toward the first developer passing portion 40*d* beyond an end part of the partition wall 41*a*).

The developer at the downstream-side end (the left end in FIG. 4) of the second transport passage 40*b* is acted upon by the magnetism, or rotational force, of the developing roller 20. Accordingly, near the second developer passing portion 40*e* where developer is fed from the second transport passage 40*b* to the first transport passage 40*a*, no stagnation of developer is likely to occur, and no wall of developer is likely to form. Thus, it suffices to form a paddle portion 50 in an end part of the first spiral 31 facing the first developer passing portion 40*d*.

Figure 9:
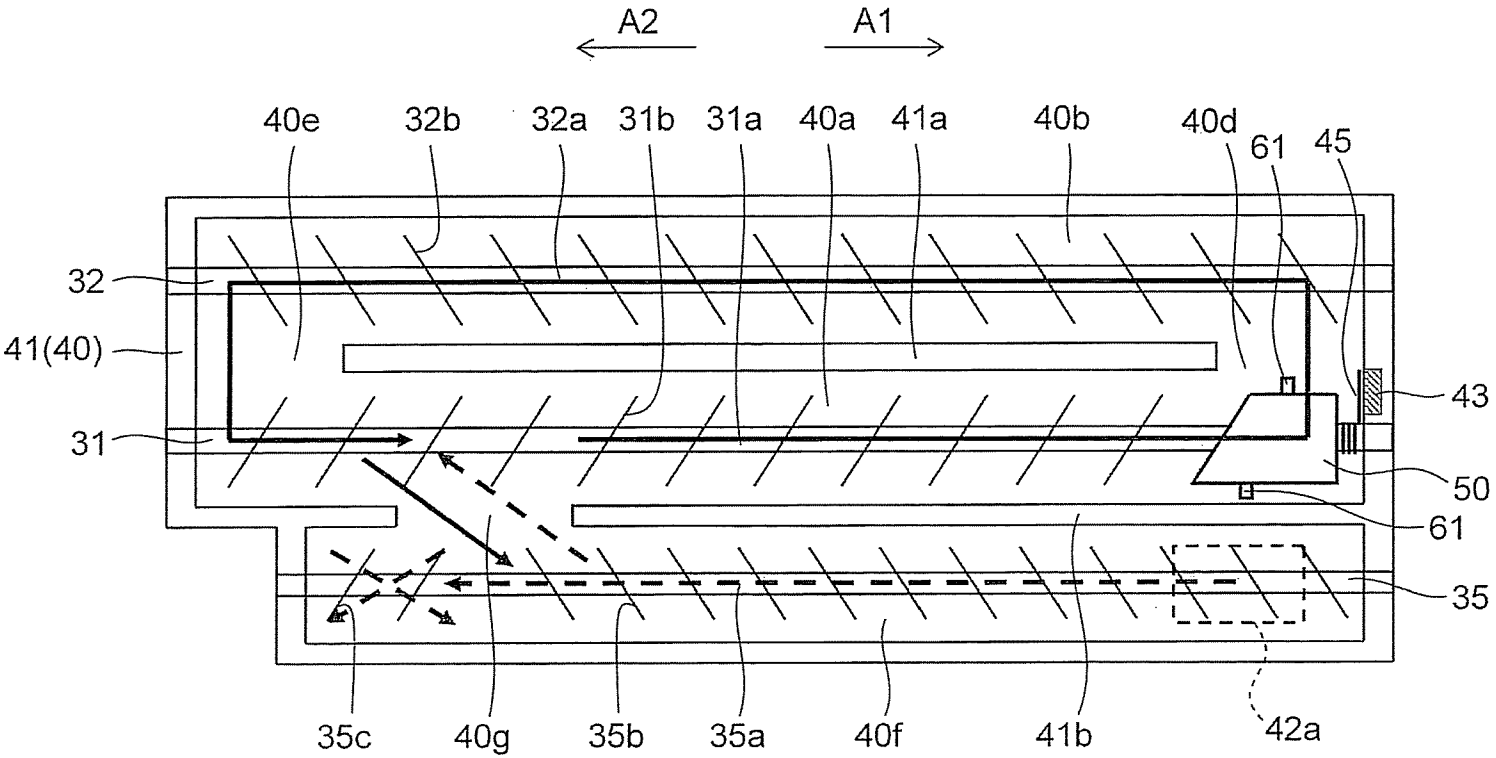
FIG. 9 is a plan sectional view showing a structure of a stirring portion of a developing device 4 according to a second embodiment of the present disclosure.
Figure 10:
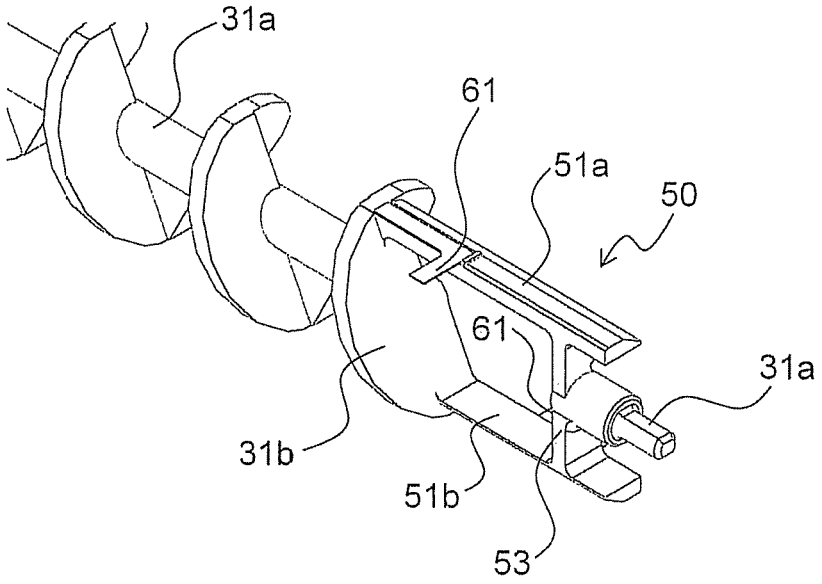
FIG. 10 is a partly enlarged view of and around a paddle portion 50 of a first spiral 31 used in a developing device 4 according to the second embodiment.
Figure 11:
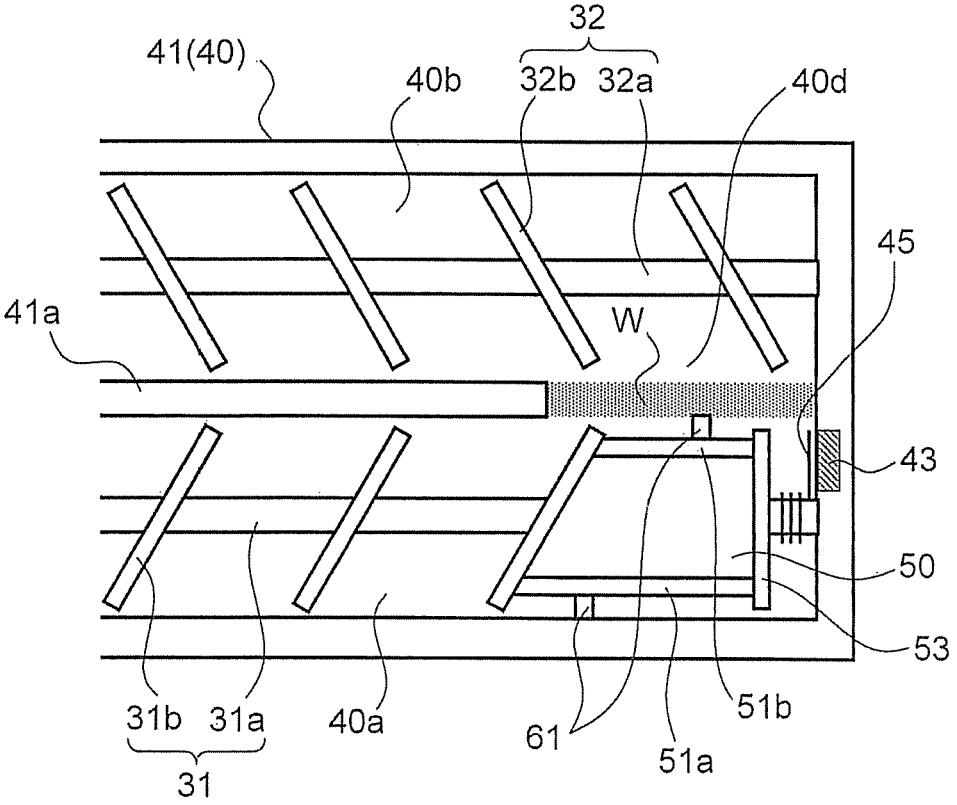
FIG. 11 is a partly enlarged view of and around a first developer passing portion 40*d* in FIG. 9.

FIG. 9 is a plan sectional view showing the structure of a stirring portion of a developing device 4 according to a second embodiment of the present disclosure. FIG. 10 is a partly enlarged view of and around a paddle portion 50 of a first spiral 31 used in the developing device 4 according to the second embodiment. FIG. 11 is a partly enlarged view of and around a first developer passing portion 40*d* in FIG. 9. In this embodiment, in the paddle portion 50 of the first spiral 31, a developer breaking member 61 is additionally provided which serves to break a wall of developer formed inside the first developer passing portion 40*d*.

As shown in FIG. 10, two such developer breaking members 61 are provided one on the outer face of each of the first ribs 51*a* and 51*b*. The respective developer breaking members 61 protrude from different positions in the direction of the rotary shaft 31*a* of the first spiral 31. The tip ends of the developer breaking members 61 extend in the rotation direction of the first spiral 31 (the direction of the line normal to the rotation orbit of the first ribs 51*a* and 51*b*). As the first spiral 31 rotates, the developer breaking members 61 rotate with their tip ends sliding on the inner wall surface of the first transport passage 40*a* so that, when the first ribs 51*a* and 51*b* approach the first developer passing portion 40*d*, the tip ends of the developer breaking members 61 reach inside the first developer passing portion 40*d* and make contact with a developer wall W (a hatched part in FIG. 11) formed inside the first developer passing portion 40*d*.

As the first spiral 31 rotates about the rotary shaft 31*a*, a thrusting force acting in the axial direction is produced in the spiral portion of the first spiral 31 (where the first helical blade 31*b* is formed), and causes developer to be transported in the A1 direction inside the first transport passage 40*a*. In a part facing the first developer passing portion 40*d*, as the first spiral 31 rotates, the paddle portion 50 rotates together, and thus, as the first ribs 51*a* and 51*b* rotate, developer is fed via the first developer passing portion 40*d* into the second transport passage 40*b*. Moreover, inside the first developer passing portion 40*d*, the momentum with which developer on the upstream side is transported causes developer to be passed into the second transport passage 40*b*.

However, in the first developer passing portion 40*d*, there is a region where the transporting forces of the first spiral 31 and the second spiral 32 do not act. In particular, when the amount of developer remaining inside the developer container 40 is small, the pressure of the developer fed out of the first transport passage 40*a* is low. This causes developer to accumulate inside the first developer passing portion 40*d*, and as shown in FIG. 11, a developer wall W is formed as if stopping the first developer passing portion 40*d*. As a result, around the upstream side of the first developer passing portion 40*d*, developer stagnates, increasing the output value of the toner sensor 43.

On the other hand, more than a predetermined amount of developer stagnates around the upstream side of the first developer passing portion 40*d*, under the pressure of the stagnating developer, the developer wall W formed inside the first developer passing portion 40*d* breaks. As a result, the amount of developer around the upstream side of the first developer passing portion 40*d* sharply diminishes, reducing the output value of the toner sensor 43. Through repetition of such a sequence of events, the output value of the toner sensor 43 becomes unstable.

As a solution, in this embodiment, by use of the developer breaking members 61 additionally provided on the first ribs 51*a* and 51*b* of the paddle portion 50, the developer wall W inside the first developer passing portion 40*d* is broken, so that developer does not stagnate around the upstream side of the first developer passing portion 40*d*. Thus, even in cases where there is a small amount of developer inside the developer container 40 or where developer has deteriorated to have lower flowability, it is possible to keep the output value of the toner sensor 43 stable, and to control the feeding of toner from the toner container 5 to the developing device 4 more accurately.

Preferred as the material for the developer breaking members 61 is elastically deformable resin film such as PET film. The greater the width (the dimension in the direction of the rotary shaft 31*a*) of the developer breaking members 61, the stronger the effect of breaking the developer wall W, but disadvantageously the larger the amount of developer that attaches to the developer breaking members 61. The developer thus attached to the developer breaking member 61 may cause erroneous detection by the toner sensor 43. Accordingly, a preferred width of the developer breaking members 61 is about 1 mm to 10 mm. For effective breaking of the developer wall W inside the first developer passing portion 40*d*, the amount of protrusion (the dimension in the rotation direction) of the developer breaking members 61 is preferably set such that the tip ends of the developer breaking members 61 protrude outside the rotation orbit of the first helical blade 31*b* in the radial direction.

If the developer breaking member 61 is provided near the detection surface of the toner sensor 43, the toner sensor 43 detects the toner attached to the developer breaking member 61, and thus the sensor output is affected. To avoid that, the developer breaking member 61 is preferably provided outside the detectable range of the toner sensor 43, and in the depth direction (the leftward direction in FIG. 11) of the developer container 40 with respect to the detection surface of the toner sensor 43.

Figure 12:
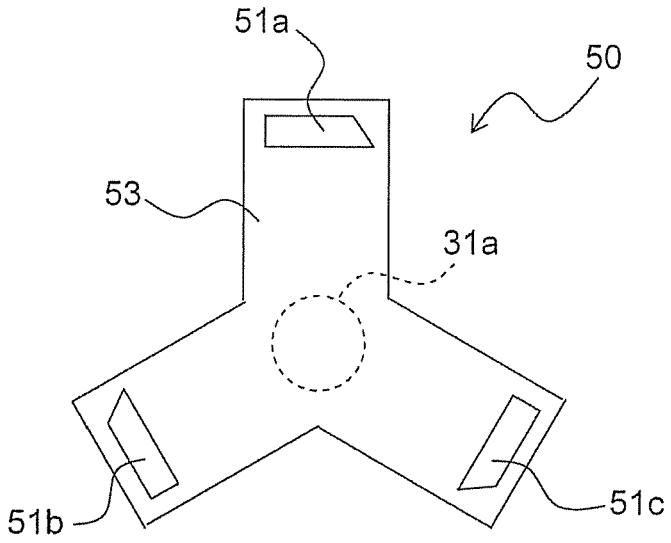
FIG. 12 is a diagram showing another example of a structure of a paddle portion 50 in a developer 4 according to the second embodiment.

The embodiments described above are in no way meant to limit the present disclosure, which thus allows for many modifications and variations within the spirit of the present disclosure. For example, while the above embodiments deal with a structure where the paddle portion 50 of the first spiral 31 has a pair of first ribs 51*a* and 51*b* at opposite positions across the center line of the rotary shaft 31*a*, with a larger first spiral 31 having a first helical blade 31*b* with a comparatively large outer diameter, the paddle portion 50 may have three first ribs 51*a* to 51*c* as shown in FIG. 12; it may even have four or more first ribs 51. In that case, the first ribs 51 are preferably provided at equal intervals about the center line of the rotary shaft 31*a*.

While the above embodiments deal with the use of the first and second spirals 31 and 32 that have the helical blades 31*b* and 32*b* continuously formed around the rotary shafts 31*a* and 32*a* respectively, the helical blades 31*b* and 32*b* are not meant to be any limitation. Instead, for example, stirring/transporting members may be used that have a plurality of semicircular plates (circular plates divided into two parts) arranged alternately at predetermined inclination angles around the rotary shafts 31*a* and 32*a*.

While the above embodiments deal with examples where a one-component developer containing magnetic toner alone is used as developer, this is in no way meant to limit the present disclosure. Instead, as developer, two-component developer may be used that contains magnetic carrier and toner. With a two-component development method using two-component developer, the smaller the amount of toner inside the developing device 4 becomes, the higher the proportion of magnetic carrier becomes, and thus the higher the output value of the toner sensor 43 becomes.

The embodiments described above are applicable, not only to monochrome printers like the one shown in FIG. 1, but to digital and analog monochrome copiers, color printers, color copiers, facsimile machines, etc., that is, various image forming apparatuses provided with a developing device including a first stirring/transporting member, a second stirring/transporting member, and a developer feeding member. Hereinafter, the benefits of the present disclosure will be described in detail by way of practical examples.

TEST EXAMPLE 1

Figure 13:
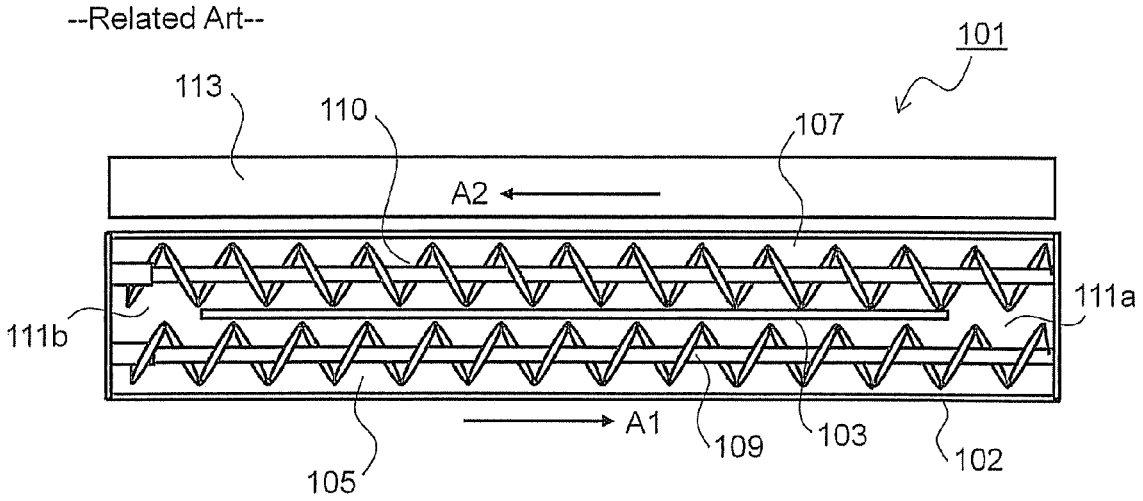
FIG. 13 is a plan sectional view showing a structure of a stirring portion of a developing device 101 of Comparative Example 1, provided with a first spiral 109 having no paddle portion 50 formed in it.
Figure 14:
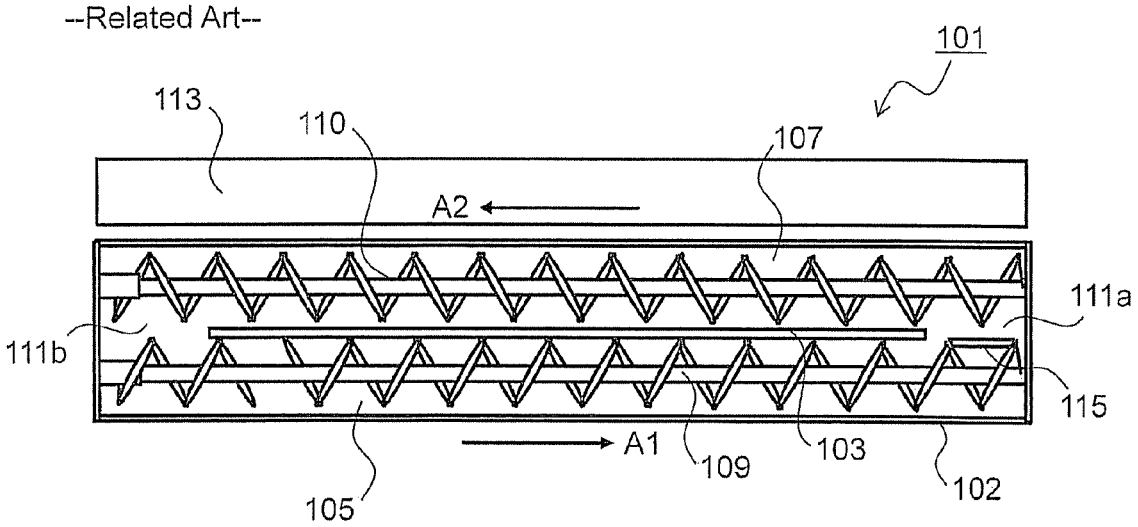
FIG. 14 is a plan sectional view showing a structure of a stirring portion of a developing device 101 of Comparative Example 2, provided with a first spiral 109 having a rib 115 additionally formed on it.

The relationship between the shape of the first spiral 31 and the circulation behavior of developer inside the developer container 40 was studied. The tests were conducted on the following developing devices: (as Practical Example 1) the developing device 4 according to the first embodiment shown in FIG. 4, provided with the first spiral 31 having the paddle portion 50 formed in a part thereof facing the first developer passing portion 40*d*; (as Comparative Example 1) a developing device 101 as shown in FIG. 13, provided with a spiral portion 109 having no paddle portion 50 formed in it; and (as Comparative Example 2) a developing device 101 as shown in FIG. 14, additionally provided with a rib 115 on a part of a first helical blade facing a developer passing portion 111*a*. Each of these developing devices was charged with a predetermined amount of developer and, while it was operated, how the developer circulated was visually inspected. The developing devices 101 shown in FIGS. 13 and 14 had a structure similar to that of the developing device 4, though the respective developer refill passages are omitted from illustration there.

In all of Practical Example 1 and Comparative Examples 1 and 2, the first spiral 31 (109) and the second spiral 32 (110) had a helical blade with a diameter of 20 mm and a pitch of 20 mm, and were rotated at 34.5 rpm (revolutions per minute). The first developer passing portion 40*d* (111*a*) had an opening width of 31 mm, the second developer passing portion 40*e* (111*b*) had an opening width of 31 mm, and the gap between the developer container 40 (120) and each of the first spiral 31 (109) and the second spiral 32 (110) was 1.5 mm.

The test results reveal the following. In the developing device 4 of Practical Example 1, where the first spiral 31 had the paddle portion 50 formed in it, developer promptly circulated through the first transport passage 40*a*, the first developer passing portion 40*d*, the second transport passage 40*b*, and the second developer passing portion 40*e*, and the extent of attachment of developer to the first ribs 51*a* and 51*b* was so small as to be acceptable in practical use.

By contrast, in the developing device 101 of Comparative Example 1, where the first spiral 31 had no paddle portion 50 formed in it, developer stagnated in the developer passing portion 111*a* from the first transport passage 105 to the second transport passage 107, and developer adhered to the inner surface of the developer container 40 (the reverse surface of the cover member 42). In the developing device 101 of Comparative Example 2, where the transport rib 115 was added to a part of the first helical blade facing the developer passing portion 111*a*, developer attached to the transport rib 115.

TEST EXAMPLE 2

The relationship between the amount of developer inside the developer container 40 and the output of the toner sensor 43 as observed when the developer breaking member 61 is additionally provided on the paddle portion 50 was studied. The tests were conducted on the following developing devices: (as Practical Example 2) the developing device 4 according to the second embodiment shown in FIG. 9, provided with the first spiral 31 in which, as shown in FIG. 10, the developer breaking members 61 with a length of 8.5 mm and a width of 2 mm were additionally provided on the first ribs 51*a* and 51*b* of the paddle portion 50 so as to leave an interval of 3.5 mm from the toner sensor 43; and (as Practical Example 1) the developing device 4 according to the first embodiment shown in FIG. 4, provided with the first spiral 31 in which, as shown in FIG. 6, no developer breaking member 61 was additionally provided on the first ribs 51*a* and 51*b* of the paddle portion 50. Each of these developing devices was charged with new developer or deteriorated developer, in varying amounts from 70 g to 150 g, and while it was operated, the output value of the toner sensor 43 was measured. The results are shown in FIGS. 15 and 16.

Figure 15:
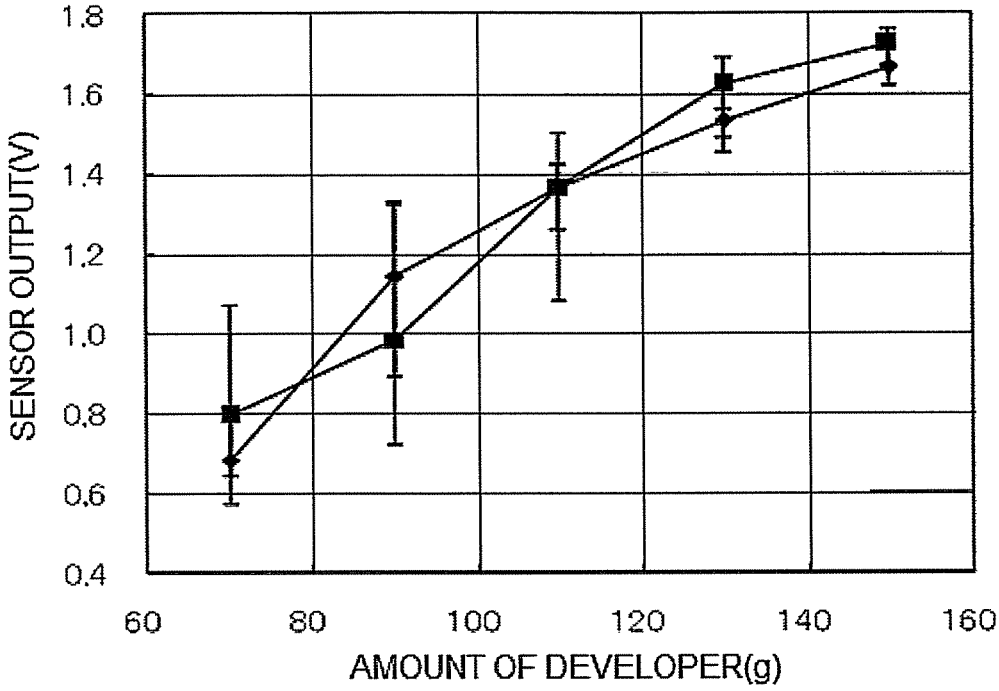
FIG. 15 is a graph showing the results of measurement of the output value of a toner sensor 43 when a developing device 4 according to Practical Example 2, provided with a first spiral 31 having a developer breaking member 61 additionally provided on it, was charged with new or deteriorated developer in varying amounts from 70 g to 150 g and operated.
Figure 16:
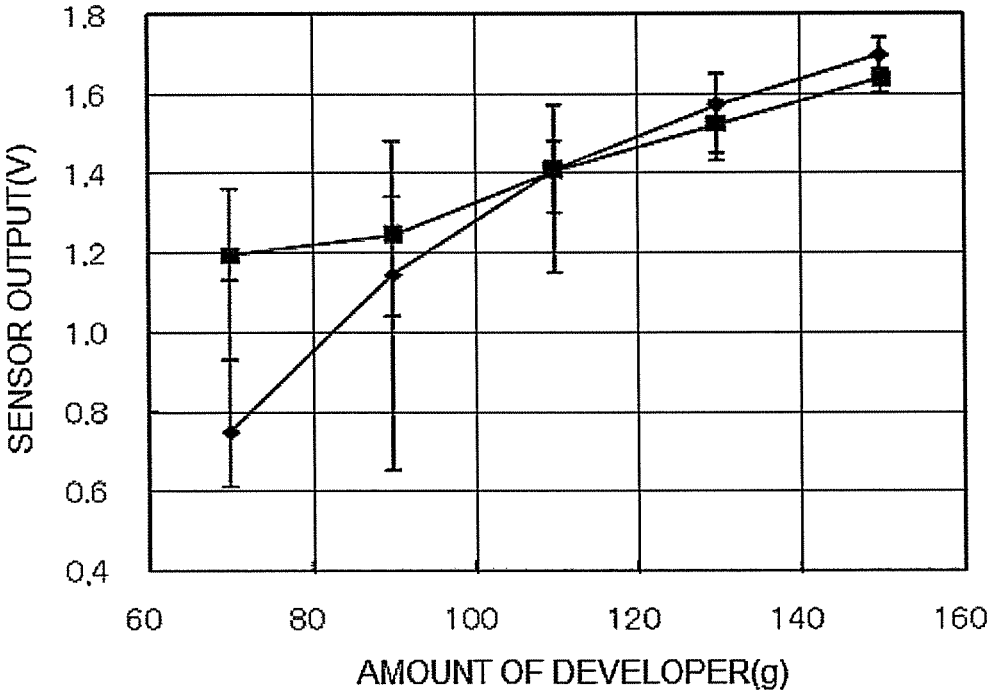
FIG. 16 is a graph showing the results of measurement of the output value of a toner sensor 43 when a developing device 4 according to Practical Example 1, provided with a first spiral 31 having no developer breaking member 61 additionally provided on it, was charged with new or deteriorated developer in varying amounts from 70 g to 150 g and operated.

As will be clear from FIG. 15, with the structure of Practical Example 2, where the developer breaking members 61 were additionally provided on the first ribs 51*a* and 51*b* of the paddle portion 50, with both new developer (the series of data indicated by diamonds in the diagrams) and deteriorated developer (the series of data indicated by squares in the diagram), a good correlation was observed between the developer amount and the sensor output value, indicating high sensitivity in the output of the toner sensor 43. This is considered to have resulted from, even with a reduced amount of developer inside the developer container 40, the developer breaking members 61 preventing formation of a toner wall around the toner sensor 43 and allowing the sensor output to change stably.

By contrast, as will be clear from FIG. 16, with the developing device 4 of Practical Example 1, where no developer breaking member 61 was additionally provided on the first ribs 51*a* and 51*b* of the paddle portion 50, once the amount of developer fell below 90 g, the sensor output value exhibited a deviation between new developer (the series of data indicated by diamonds in the diagrams) and deteriorated developer (the series of data indicated by squares in the diagram). These results confirm that the developing device 4 according to the second embodiment, where the developer breaking members 61 are additionally provided on the first ribs 51*a* and 51*b* of the paddle portion 50, is more suitable, than the developing device 4 according to the first embodiment, where no developer breaking member 61 is additionally provided, for feedback control in which whether to supply developer or not is determined based on the output value of the toner sensor 43.

The present disclosure is applicable to developing devices in which developer is transported to circulate through a first transport passage and a second transport passage arranged side by side and through developer passing portions. Based on the present disclosure, it is possible to obtain a developing device that can effectively suppress agglomeration and adhesion of developer in a developer passing portion.

What is claimed is:

1. A developing device comprising:

a developer container having a first transport passage and a second transport passage arranged substantially parallel to each other, the developer container storing developer containing toner;

a developer carrier rotatably supported on the developer container, the developer carrier carrying, on a surface thereof, the developer inside the second transport passage;

a first stirring/transporting member comprising a rotary shaft and a transport blade formed on a circumferential surface of the rotary shaft, the first stirring/transporting member stirring and transporting the developer inside the first transport passage;

a second stirring/transporting member stirring and transporting the developer inside the second transport passage in a direction opposite to the first stirring/transporting member;

a first developer passing portion through which the developer is delivered from the first transport passage to the second transport passage;

a second developer passing portion through which the developer is delivered from the second transport passage to the first transport passage;

a paddle portion formed in a part of the first stirring/transporting member facing the first developer passing portion, the paddle portion being devoid of the rotary shaft and including a plurality of first ribs parallel to the rotary shaft, wherein the paddle portion is in a shape of a frame having a rectangular shape as seen in a plan view by being surrounded by the transport blade, which is located at a most downstream-side end with respect to the developer transport direction, two of the first ribs, which extend from the transport blade parallel to the rotary shaft, and a second rib, which couples together respective end parts of the first ribs and which extends perpendicularly to the rotary shaft, the rotary shaft being connected to a face of the second rib facing away from a face thereof to which the first ribs are coupled.

2. The developing device according to claim 1, wherein the transport blade at the most downstream-side end of the paddle portion with respect to the developer transport direction has at least a part thereof so formed as to overlap the first developer passing portion in a direction of the rotary shaft.

3. An image forming apparatus comprising the developing device according to claim 1.

4. A developing device comprising:

a developer container having a first transport passage and a second transport passage arranged substantially parallel to each other, the developer container storing developer containing toner;

a developer carrier rotatably supported on the developer container, the developer carrier carrying, on a surface thereof, the developer inside the second transport passage;

a first stirring/transporting member comprising a rotary shaft and a transport blade formed on a circumferential surface of the rotary shaft, the first stirring/transporting member stirring and transporting the developer inside the first transport passage;

a second stirring/transporting member stirring and transporting the developer inside the second transport passage in a direction opposite to the first stirring/transporting member;

a first developer passing portion through which the developer is delivered from the first transport passage to the second transport passage;

a second developer passing portion through which the developer is delivered from the second transport passage to the first transport passage;

a paddle portion formed in a part of the first stirring/transporting member facing the first developer passing portion, the paddle portion being devoid of the rotary shaft and including a plurality of first ribs parallel to the rotary shaft, and a developer breaking member for breaking a wall of developer formed at the first developer passing portion and provided on the first ribs of the paddle portion.

5. The developing device according to claim 4, wherein the developer breaking member protrudes outside a rotation orbit of the transport blade of the first stirring/transporting member in a radial direction.

6. The developing device according to claim 4, wherein the developer breaking member comprises a plurality of developer breaking members provided on the plurality of first ribs respectively at different positions thereon in a direction of the rotary shaft.

7. The developing device according to claim 4, wherein a toner sensor for detecting an amount or concentration of toner inside the developer container is arranged on an inner wall surface of a downstream-side end part of the first transport passage with respect to a transport direction, near the first developer passing portion, the developer breaking member being arranged at a position where the developer breaking member does not make contact with a detection surface of the toner sensor.

8. An image forming apparatus comprising the developing device according to claim 4.

* * * * *